US010927724B2

(12) United States Patent
Nielsen et al.

(10) Patent No.: US 10,927,724 B2
(45) Date of Patent: Feb. 23, 2021

(54) ROCKER ARM ASSEMBLY

(71) Applicant: Eaton Corporation, Cleveland, OH (US)

(72) Inventors: Douglas J. Nielsen, Marshall, MI (US); James E. McCarthy, Jr., Kalamazoo, MI (US); Kshamta Bishnoi, Pune (IN); Kiran Bairy, Pune (IN); Majo Cecur, Rivarolo Canavese (IT)

(73) Assignee: Eaton Corporation, Cleveland, OH (US)

( * ) Notice: Subject to any disclaimer, the term of this patent is extended or adjusted under 35 U.S.C. 154(b) by 75 days.

(21) Appl. No.: 16/154,184

(22) Filed: Oct. 8, 2018

(65) Prior Publication Data

US 2019/0040769 A1 Feb. 7, 2019

Related U.S. Application Data

(63) Continuation-in-part of application No. PCT/US2017/026541, filed on Apr. 7, 2017.
(Continued)

(30) Foreign Application Priority Data

Apr. 7, 2016 (IN) ..... 201611012287
Apr. 28, 2016 (IN) ..... 201611014772

(51) Int. Cl.
*F01L 13/06* (2006.01)
*F01L 1/18* (2006.01)
(Continued)

(52) U.S. Cl.
CPC ..... *F01L 13/065* (2013.01); *F01L 1/182* (2013.01); *F01L 1/2416* (2013.01); *F01L 1/267* (2013.01);
(Continued)

(58) Field of Classification Search
None
See application file for complete search history.

(56) References Cited

U.S. PATENT DOCUMENTS 5,353,756 A 10/1994 Murata et al.
5,495,838 A 3/1996 Johnson, Jr.
(Continued)

OTHER PUBLICATIONS

International Search Report and Written Opinion for International Application No. PCT/US2017/026541 dated Jul. 20, 2017, 17 pages.

*Primary Examiner* — Kevin R Steckbauer
(74) *Attorney, Agent, or Firm* — RMCK Law Group PLC

(57) ABSTRACT

A valve train assembly includes a first exhaust valve, a second exhaust valve, and a valve bridge including a main body and a lever rotatably coupled to the main body, the main body configured to engage the first exhaust valve, and the lever configured to engage the second exhaust valve. An exhaust valve rocker arm assembly is configured to selectively open the first and second exhaust valves, the exhaust valve rocker arm assembly including an exhaust valve rocker arm with a hydraulic lash adjuster (HLA) assembly coupled thereto, the HLA assembly in contact with the valve bridge main body. An engine brake rocker arm assembly is configured to selectively open the second exhaust valve and including an engine brake rocker arm with a combined HLA and added motion capsule coupled thereto. The combined HLA and added motion capsule is configured to selectively engage and rotate the lever.

14 Claims, 8 Drawing Sheets

Related U.S. Application Data

(60) Provisional application No. 62/430,102, filed on Dec. 5, 2016, provisional application No. 62/568,852, filed on Oct. 6, 2017.

(51) Int. Cl.
*F01L 1/24* (2006.01)
*F01L 1/26* (2006.01)
*F01L 1/46* (2006.01)

(52) U.S. Cl.
CPC ..... *F01L 13/06* (2013.01); *F01L 2001/188* (2013.01); *F01L 2001/467* (2013.01); *F01L 2305/00* (2020.05)

(56) References Cited

U.S. PATENT DOCUMENTS 5,806,477 A 9/1998 Regueiro
5,975,251 A 11/1999 McCarthy
5,992,376 A 11/1999 Okada et al.
6,253,730 B1 7/2001 Gustafson
8,573,171 B2 * 11/2013 Cecur ..... F01L 1/146 123/90.52
8,800,520 B2 * 8/2014 D'Amore ..... F01L 1/2422 123/90.57
9,016,249 B2 * 4/2015 Roberts ..... F01L 1/18 123/90.16
9,429,051 B2 * 8/2016 Meneely ..... F01L 1/181
9,512,745 B2 * 12/2016 Cecur ..... F01L 1/267
10,190,446 B2 * 1/2019 Cecur ..... F01L 1/18
10,260,382 B2 * 4/2019 Cecur ..... F01L 1/25
10,465,567 B2 * 11/2019 Nielsen ..... F01L 13/065
10,590,810 B2 * 3/2020 Ferreira ..... F01L 13/065
10,626,758 B2 * 4/2020 McCarthy, Jr. ..... F01L 13/065
10,626,763 B2 * 4/2020 Jo ..... F01L 1/267
10,690,024 B2 * 6/2020 VanWingerden ..... F01L 1/2416
2005/0211206 A1 9/2005 Ruggiero et al.
2008/0072857 A1 3/2008 Sailer et al.
2010/0319657 A1 12/2010 Dodi et al.
2011/0067661 A1 3/2011 Schwoerer
2011/0079195 A1 4/2011 Dilly
2011/0220062 A1 9/2011 Sailer et al.
2012/0186546 A1 * 7/2012 Cecur ..... F01L 13/0031 123/90.15
2013/0298859 A1 * 11/2013 D'Amore ..... F01L 1/2422 123/90.55
2014/0083381 A1 * 3/2014 Roberts ..... F01L 1/08 123/90.15
2014/0130774 A1 5/2014 Forestier et al.
2015/0144096 A1 * 5/2015 Meneely ..... F01L 9/02 123/321
2015/0159520 A1 * 6/2015 Cecur ..... F01L 1/2411 123/90.12
2015/0354418 A1 * 12/2015 Jo ..... F01L 1/267 123/323
2017/0016358 A1 1/2017 Yoon
2017/0175597 A1 6/2017 Cecur
2017/0321576 A1 11/2017 Nielsen
2018/0003088 A1 * 1/2018 Nielsen ..... F01L 1/181
2018/0163578 A1 * 6/2018 Kim ..... F01L 1/181
2019/0010835 A1 * 1/2019 McCarthy, Jr. ..... F01L 13/065
2019/0085738 A1 * 3/2019 VanWingerden ..... F01L 13/065
2019/0145289 A1 * 5/2019 Ferreira ..... F01L 1/26 123/90.55
2019/0264584 A1 * 8/2019 Baltrucki ..... F16K 31/607
2020/0182098 A1 * 6/2020 McCarthy, Jr. ..... F01L 1/182

* cited by examiner

ROCKER ARM ASSEMBLY

CROSS-REFERENCE TO RELATED APPLICATIONS

This application is a continuation of International Application No. PCT/US2017/026541 filed Apr. 7, 2017, which claims the benefit of Indian Patent Application No. 201611012287 filed on Apr. 7, 2016, Indian Patent Application No. 201611014772 filed on Apr. 28, 2016, and U.S. Provisional Patent Application No. 62/430,102 filed on Dec. 5, 2016. This application also claims the benefit of U.S. Provisional Patent Application No. 62/568,852 filed Oct. 6, 2017. The disclosures of the above applications are incorporated herein by reference.

FIELD

The present disclosure relates generally to a rocker arm assembly for use in a valve train assembly and, more particularly, to a rocker arm assembly having an engine braking bridge.

BACKGROUND

Compression engine brakes can be used as auxiliary brakes in addition to wheel brakes, for example, on relatively large vehicles powered by heavy or medium duty diesel engines. A compression engine braking system is arranged, when activated, to provide an additional opening of an engine cylinder's exhaust valve when the piston in that cylinder is near a top-dead-center position of its compression stroke so that compressed air can be released through the exhaust valve. This causes the engine to function as a power consuming air compressor which slows the vehicle.

In a typical valve train assembly used with a compression engine brake, the exhaust valve is actuated by a rocker arm which engages the exhaust valve by means of a valve bridge. The rocker arm rocks in response to a cam on a rotating cam shaft and presses down on the valve bridge which itself presses down on the exhaust valve to open it. A hydraulic lash adjuster may also be provided in the valve train assembly to remove any lash or gap that develops between the components in the valve train assembly.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

In one aspect of the present disclosure a valve train assembly is provided. The valve train assembly includes a first exhaust valve, a second exhaust valve, and a valve bridge including a main body and a lever rotatably coupled to the main body, the main body configured to engage the first exhaust valve, and the lever configured to engage the second exhaust valve. An exhaust valve rocker arm assembly is configured to selectively open the first and second exhaust valves, the exhaust valve rocker arm assembly including an exhaust valve rocker arm with a hydraulic lash adjuster (HLA) assembly coupled thereto, the HLA assembly in contact with the valve bridge main body. An engine brake rocker arm assembly is configured to selectively open the second exhaust valve and including an engine brake rocker arm with a combined HLA and added motion capsule coupled thereto. The combined HLA and added motion capsule is configured to selectively engage and rotate the lever to open the second exhaust valve.

In addition to the foregoing, the valve train assembly may include one or more of the following features: wherein the HLA assembly is in continuous contact with the valve bridge main body; wherein the combined HLA and added motion capsule includes a second HLA assembly and an added motion assembly, the added motion assembly configured to move between a retracted position where the combined HLA and added motion capsule does not contact the lever, and an extended position where the combined HLA and added motion capsule contacts the lever and is configured to rotate the lever to open the second exhaust valve; wherein the combined HLA and added motion capsule is coupled to the lever; wherein opening the second exhaust valve performs a brake event actuation; and wherein the lever is coupled to the main body such that rotation of the lever and engagement of the second exhaust valve occurs without rotation of the main body.

In another aspect of the present disclosure, a valve train assembly is provided. The valve train assembly includes a first exhaust valve, a second exhaust valve, and a valve bridge including a main body and a lever rotatably coupled to the main body, the main body configured to engage the first exhaust valve, and the lever configured to engage the second exhaust valve. An exhaust valve rocker arm assembly is configured to selectively open the first and second exhaust valves, the exhaust valve rocker arm assembly including an exhaust valve rocker arm with a rigid motion transfer assembly coupled thereto, the rigid motion transfer assembly in contact with the valve bridge main body. An engine brake rocker arm assembly is configured to selectively open the second exhaust valve and including an engine brake rocker arm with a combined HLA and added motion capsule coupled thereto, the combined HLA and added motion capsule configured to selectively engage and rotate the lever to open the second exhaust valve.

In addition to the foregoing, the valve train assembly may include one or more of the following features: wherein the rigid motion transfer assembly is in continuous contact with the valve bridge main body; wherein the rigid motion transfer assembly comprises a rigid body connected to a spigot disposed within a socket, the socket contacting the valve bridge main body; wherein the rigid motion transfer assembly does not include a hydraulic lash adjustment feature; wherein the combined HLA and added motion capsule includes a second HLA assembly and an added motion assembly, the added motion assembly configured to move between a retracted position where the combined HLA and added motion capsule does not contact the lever, and an extended position where the combined HLA and added motion capsule contacts the lever and is configured to rotate the lever to open the second exhaust valve; wherein the combined HLA and added motion capsule is directly coupled to the lever; and wherein the main body includes an aperture, the lever at least partially disposed within the aperture, and wherein the lever is rotatably coupled to the main body by a bridge pin extending through the main body.

In another aspect of the present disclosure, a valve train assembly is provided. The valve train assembly comprising a first exhaust valve, a second exhaust valve, and a valve bridge including a main body and a lever rotatably coupled to the main body, the main body configured to engage the first exhaust valve, and the lever configured to engage the second exhaust valve. An exhaust valve rocker arm assembly is configured to selectively open the first and second exhaust valves, the exhaust valve rocker arm assembly including an exhaust valve rocker arm with a hydraulic lash adjuster (HLA) assembly coupled thereto, the HLA assembly in contact with the valve bridge main body. An engine brake rocker arm assembly is configured to selectively open the second exhaust valve and including an engine brake rocker arm with a lost motion capsule coupled thereto, the lost motion capsule configured to selectively engage and rotate the lever to open the second exhaust valve.

In addition to the foregoing, the valve train assembly may include one or more of the following features: wherein the HLA assembly is in continuous contact with the valve bridge main body; wherein the lost motion capsule does not include a hydraulic lash adjustment feature; wherein the lost motion capsule is configured to move between an activated position and a deactivated position, wherein in the activated position, the lost motion capsule acts as a rigid body configured to transfer motion from the engine brake rocker arm to the lever to thereby rotate the lever and open the second exhaust valve, and wherein in the deactivated position, the lost motion capsule is configured to collapse when the lost motion capsule contacts the lever so as to absorb the motion of the engine brake rocker arm; wherein the lost motion capsule comprises an outer body, a plunger, a latching mechanism, and a ball pivot; wherein the lost motion capsule is directly coupled to the lever; wherein the HLA assembly comprises an outer housing, a first piston body, and a second piston body, the first piston body and the second piston body at least partially disposed within the outer housing and defining a central chamber therebetween configured to receive a fluid, and wherein the hydraulic actuator assembly further comprises a biasing mechanism disposed between the first piston body and the second piston body; and wherein the lever includes an engagement surface, an opposed side opposite the engagement surface, and a stop flange extending therefrom, wherein the engagement surface is configured to be selectively engaged by the lost motion capsule, the opposed side is configured to move upwardly against the main body when the engagement surface is moved downward, and wherein the stop flange is configured to selectively engage an edge of the main body that at least partially defines the aperture to limit downward movement of the lever.

BRIEF DESCRIPTION OF THE DRAWINGS

The present disclosure will become more fully understood from the detailed description and the accompanying drawings, wherein.

DETAILED DESCRIPTION

Figure 1:
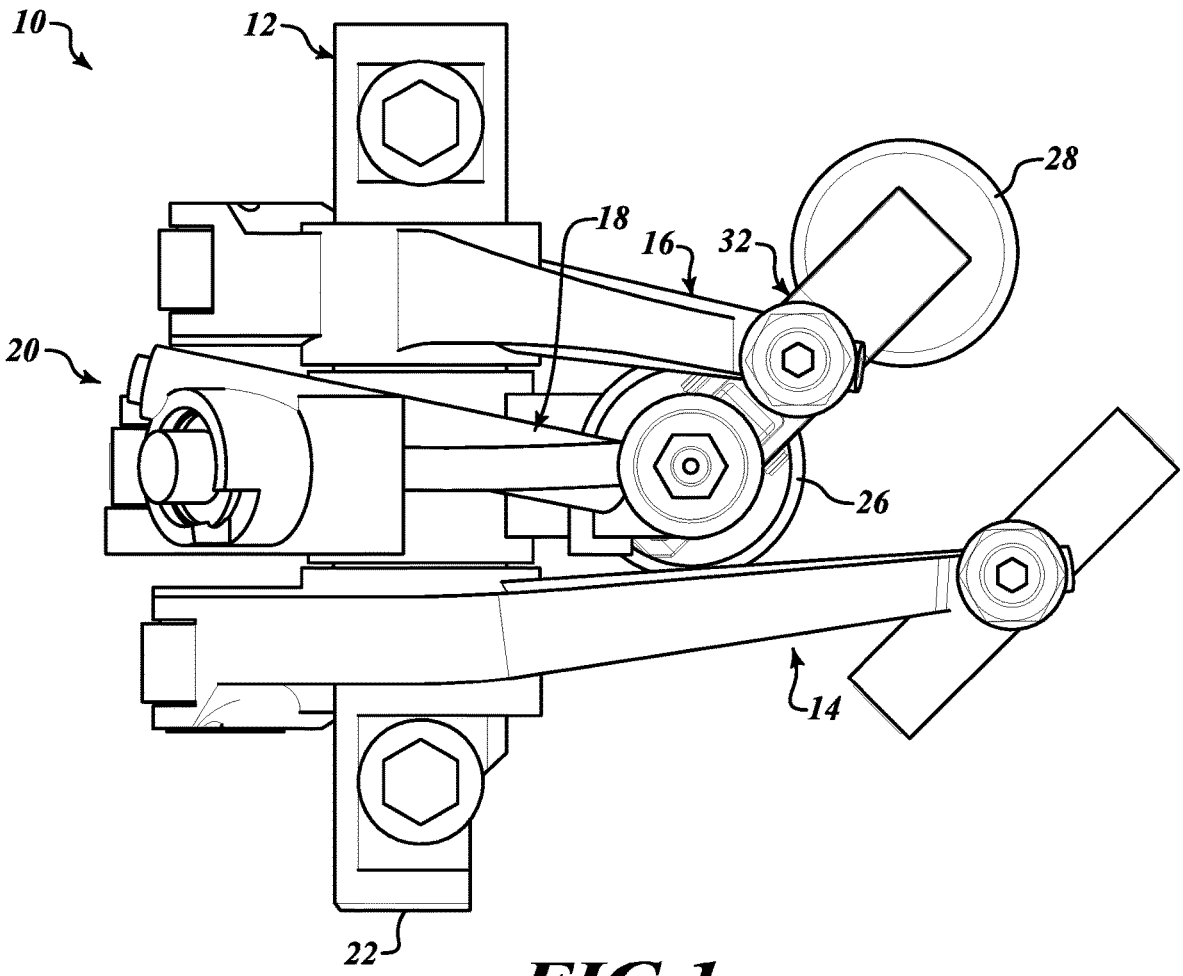
FIG. 1 is a plan view of a valve train assembly incorporating a rocker arm assembly that includes an intake rocker arm assembly, an exhaust rocker arm assembly, and an engine brake rocker arm assembly constructed in accordance to one example of the present disclosure.
Figure 2:
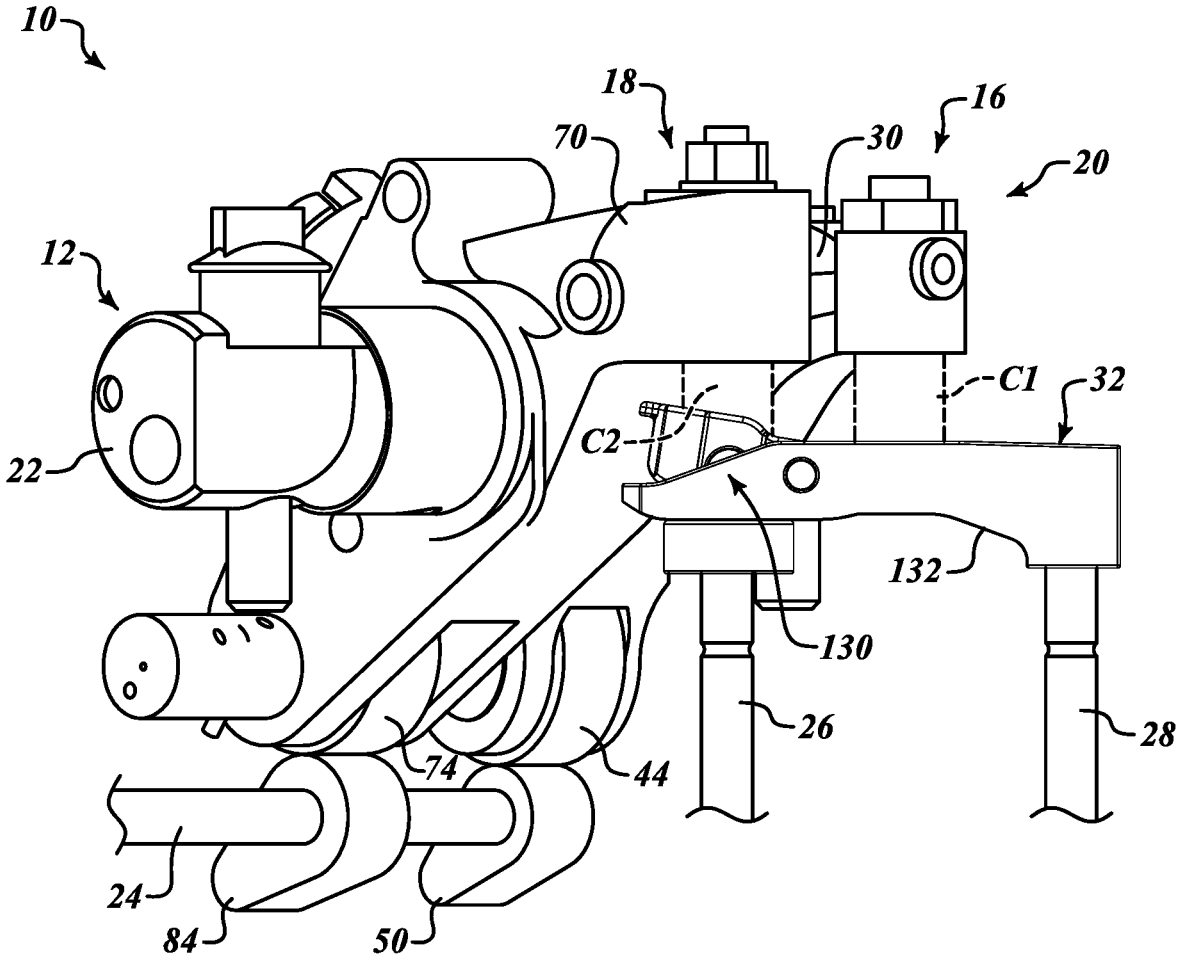
FIG. 2 is a perspective view of the valve train assembly shown in FIG. 1 without the intake rocker arm assembly.

With initial reference to FIGS. 1 and 2, a partial valve train assembly constructed in accordance to one example of the present disclosure is shown and generally identified at reference 10. The partial valve train assembly 10 utilizes engine braking and is shown configured for use in a three-cylinder bank portion of a six-cylinder engine. It will be appreciated however that the present teachings are not so limited. In this regard, the present disclosure may be used in any valve train assembly that utilizes engine braking. The partial valve train assembly 10 is supported in a valve train carrier 12 and can include three rocker arms per cylinder.

Specifically, each cylinder includes an intake valve rocker arm assembly 14, an exhaust valve rocker arm assembly 16, and an engine brake rocker arm assembly 18. The exhaust valve rocker arm assembly 16 and the engine brake rocker arm assembly 18 cooperate to control opening of the exhaust valves and are collectively referred to as a dual rocker arm assembly 20 (FIG. 2). The intake valve rocker arm assembly 14 is configured to control motion of the intake valves, the exhaust valve rocker arm assembly 16 is configured to control exhaust valve motion in a drive mode, and the engine brake rocker arm assembly 18 is configured to act on one of the two exhaust valves in an engine brake mode, as will be described herein. In alternative configurations, the exhaust valve rocker arm assembly 16 and the engine brake rocker arm assembly 18 may be combined into a single rocker arm referred to as a combined exhaust and engine brake rocker arm assembly.

A rocker shaft 22 is received by the valve train carrier 12 and supports rotation of the exhaust valve rocker arm assembly 16 and the engine brake rocker arm assembly 18. As described herein in more detail, the rocker shaft 22 can communicate oil to the assemblies 16, 18 during operation. A cam shaft 24 includes lift profiles or cam lobes configured to rotate assemblies 16, 18 to activate first and second exhaust valves 26 and 28, as is described herein in more detail.

As shown in FIG. 2, exhaust valve rocker arm assembly 16 includes a component C1 operably associated with a valve bridge assembly 32, and the engine brake rocker arm assembly 18 includes a component C2 operably associated with a movable lever assembly 130 that is into the valve bridge assembly 32. Components C1 and C2 are configured to transfer motion (sometimes selectively) between their associated rocker arm assembly 16, 18 and respective valve bridge assembly 32 and movable lever assembly 130.

Figure 3:
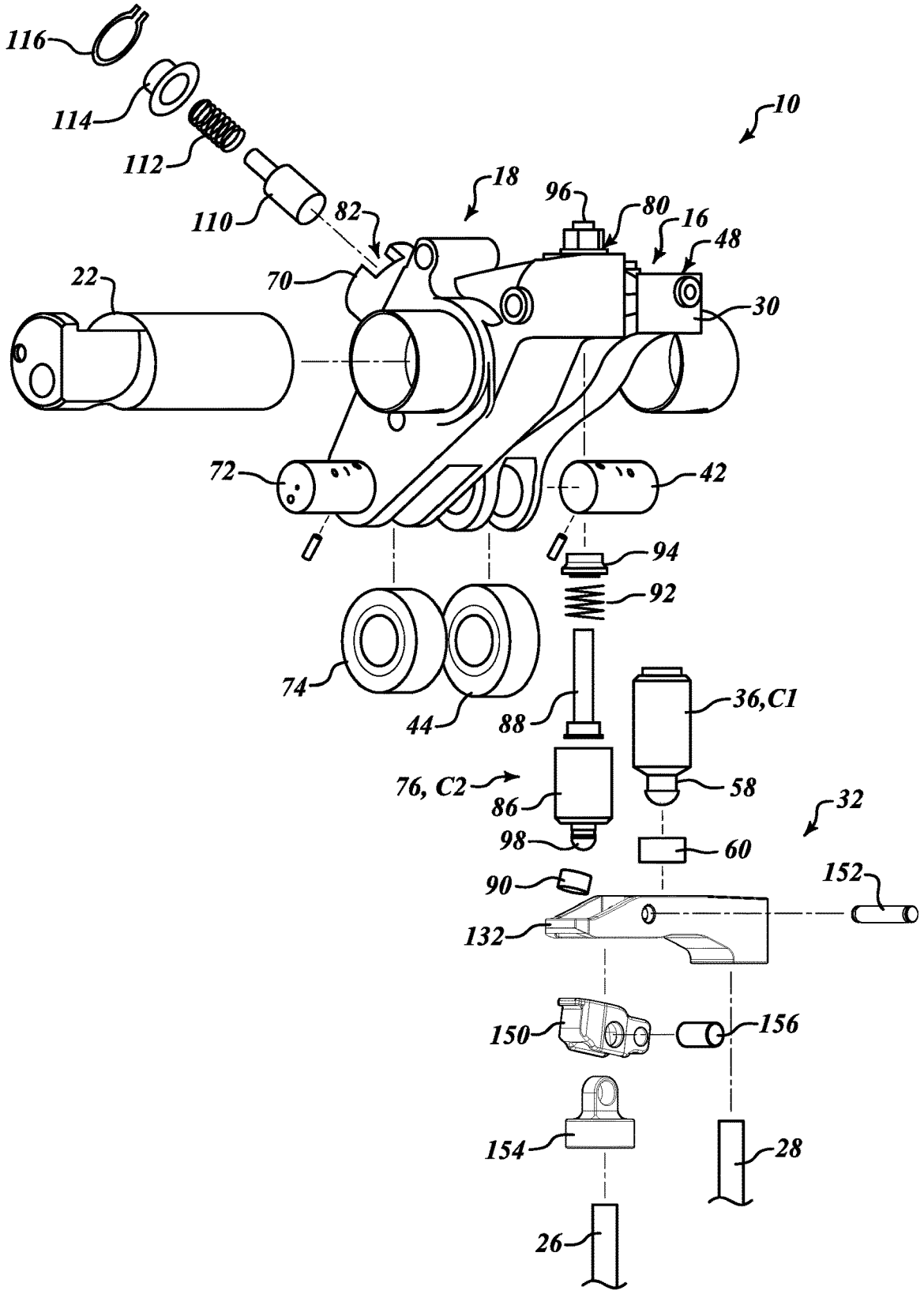
FIG. 3 is an exploded view of the exhaust valve rocker arm assembly and the engine brake rocker arm assembly of FIG. 1.
Figure 4:
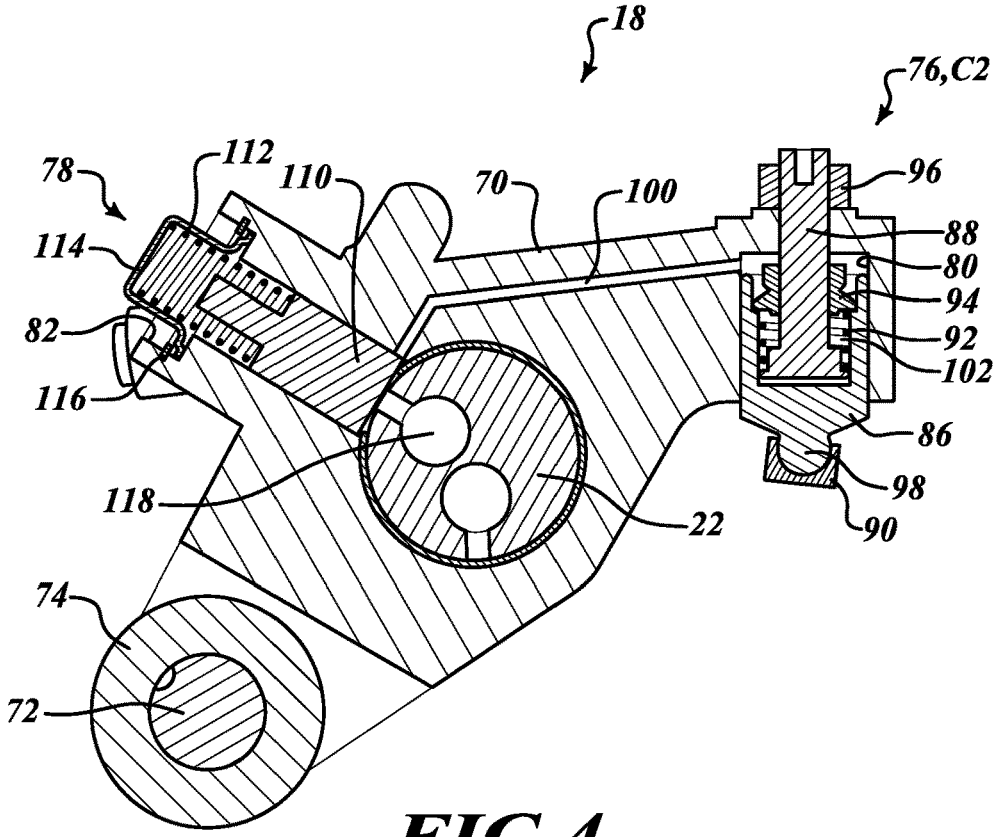
FIG. 4 is a cross-sectional view of the engine brake rocker arm assembly shown in FIG. 3 and taken along line 4-4.
Figure 5:
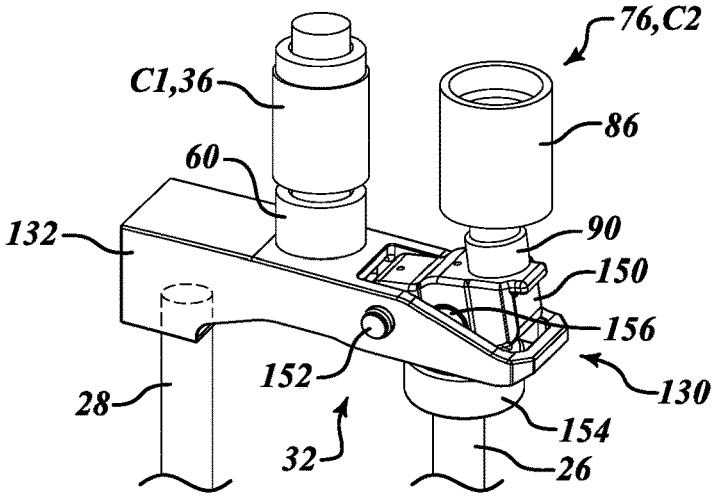
FIG. 5 is a perspective view of a portion of the rocker arm assembly shown in FIG. 1.
Figure 10:
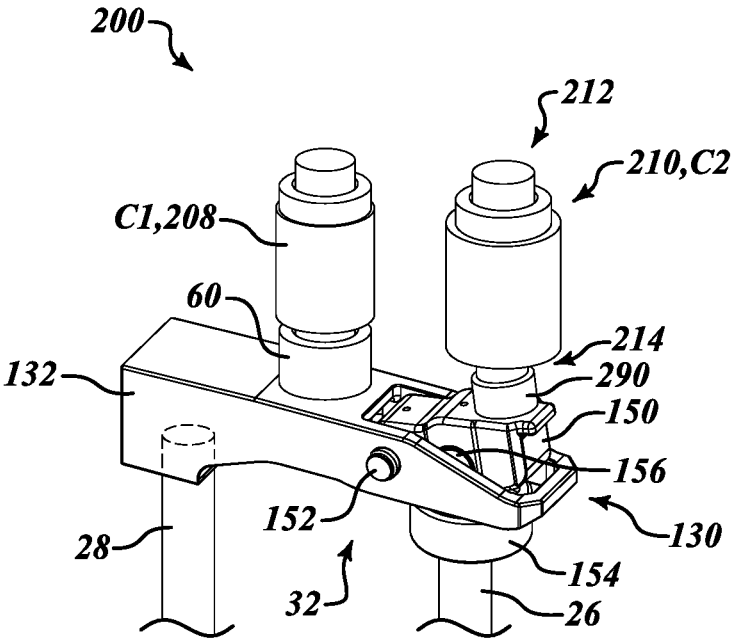
FIG. 10 is a perspective view of another configuration of the rocker arm assembly shown in FIG. 2.
Figure 11:
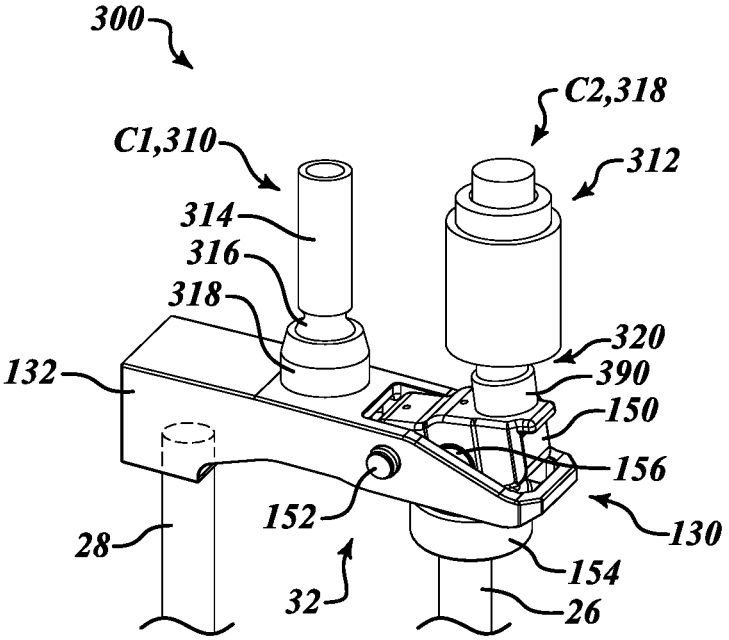
FIG. 11 is a perspective view of yet another configuration of the rocker arm assembly shown in FIG. 2.
Figure 12:
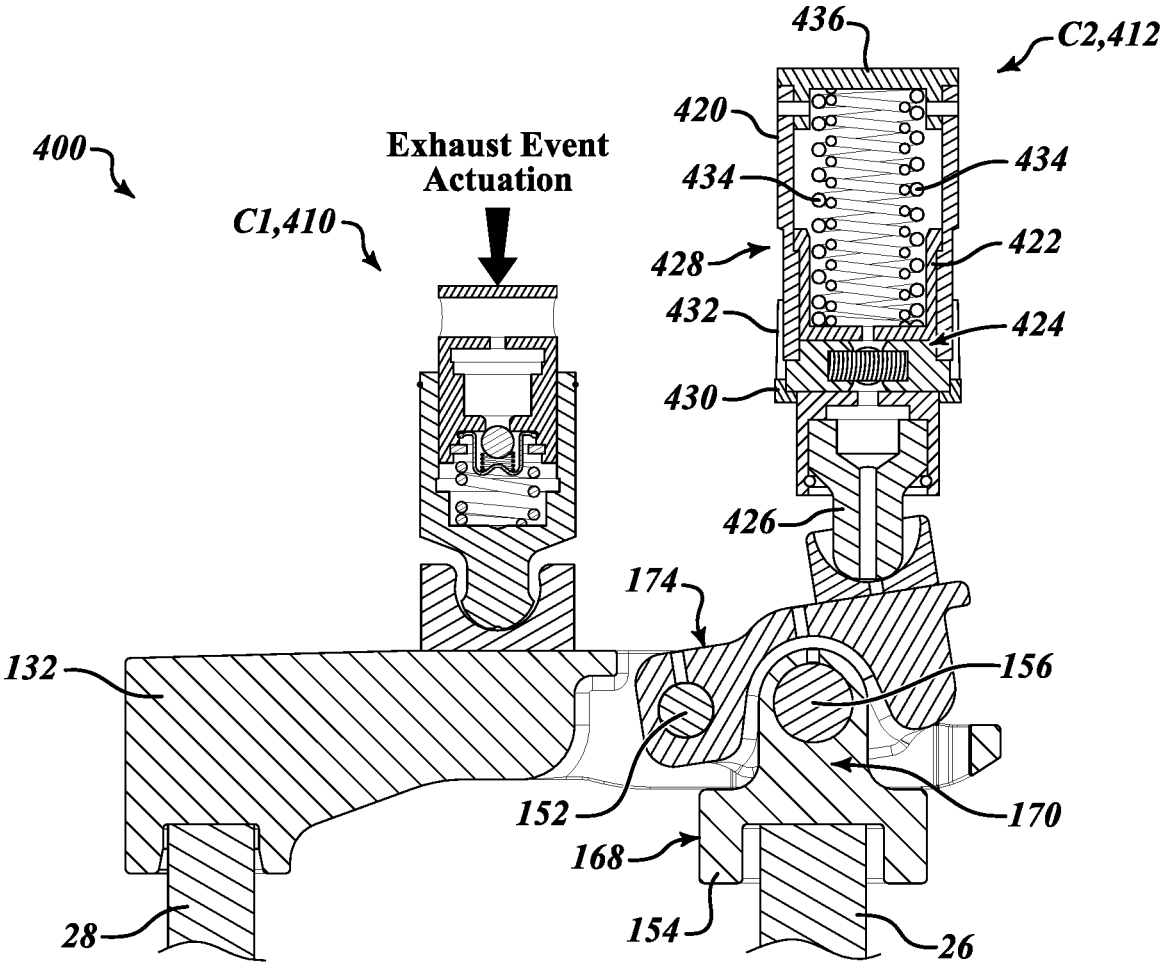
FIG. 12 is a cross-sectional view of yet another configuration of the rocker arm assembly shown in FIG. 2.

As described herein in more detail, various configurations and/or combinations of the components C1 and C2 can provide various engine control techniques. For example, a first configuration shown in FIGS. 3-5 illustrates C1 as a hydraulic lash adjuster (HLA) assembly 36 and C2 as an actuator or piston assembly 76 without HLA features. A second configuration shown in FIG. 10 illustrates C1 as an HLA assembly 208 and C2 as a combined HLA and added motion capsule 210. A third configuration shown in FIG. 11 illustrates C1 as a rigid motion transfer assembly 310 without HLA features, and C2 as a combined HLA and added motion capsule 312. A fourth configuration shown in FIG. 12 illustrates C1 as an HLA assembly 410 and C2 as a lost motion capsule 412 without HLA features.

Such engine control techniques that can be accomplished with the various configurations note above include, but are not limited to: Variable Valve Lift (VVL), Early Intake Valve Opening (EIVO), Early Intake Valve Closing (EIVC), Late Intake Valve Opening (LIVO), Late Intake Valve Closing (LIVC), Early Exhaust Valve Opening (EEVO), Early Exhaust Valve Closing (EEVC), Late Exhaust Valve Opening (LEVO), Late Exhaust Valve Closing (LEVC), a combination of EEVC and LIVO, Negative Valve Overlap (NVO), or other engine control techniques.

With further reference now to FIGS. 2 and 3, exhaust valve rocker arm assembly 16 will be further described. The exhaust valve rocker arm assembly 16 can generally include an exhaust rocker arm 30, valve bridge assembly 32, and hydraulic lash adjuster (HLA) assembly 36.

The exhaust rocker arm 30 includes a body 40, an axle 42, and a roller 44. Body 40 can receive the rocker shaft 22 and defines a bore 48 configured to at least partially receive the HLA assembly 36. The axle 42 can be coupled to the body 40 and can receive the roller 44, which is configured to be engaged by an exhaust lift profile or cam lobe 50 (FIG. 2) of the cam shaft 24. As such, when roller 44 is engaged by the exhaust lift profile 50, the exhaust rocker arm 30 is rotated downward, causing downward movement of the valve bridge assembly 32, which engages the first and second exhaust valve 26 and 28 (FIG. 2) associated with a cylinder of an engine (not shown).

The HLA assembly 36 is configured to take up any lash between the HLA assembly 36 and the valve bridge assembly 32. With additional reference to FIGS. 8 and 9, in one exemplary implementation, the HLA assembly 36 can comprise a plunger assembly 52 including a leak down plunger or first plunger body 54 and a ball plunger or second plunger body 56. The plunger assembly 52 is received by bore 48 defined in rocker arm 30, and can have a first closed end defining a spigot 58, which is received in a socket 60 that acts against the valve bridge assembly 32. The second plunger body 56 has an opening that defines a valve seat 62, and a check ball assembly 64 can be positioned between the first and second plunger bodies 54, 56.

Figure 8:
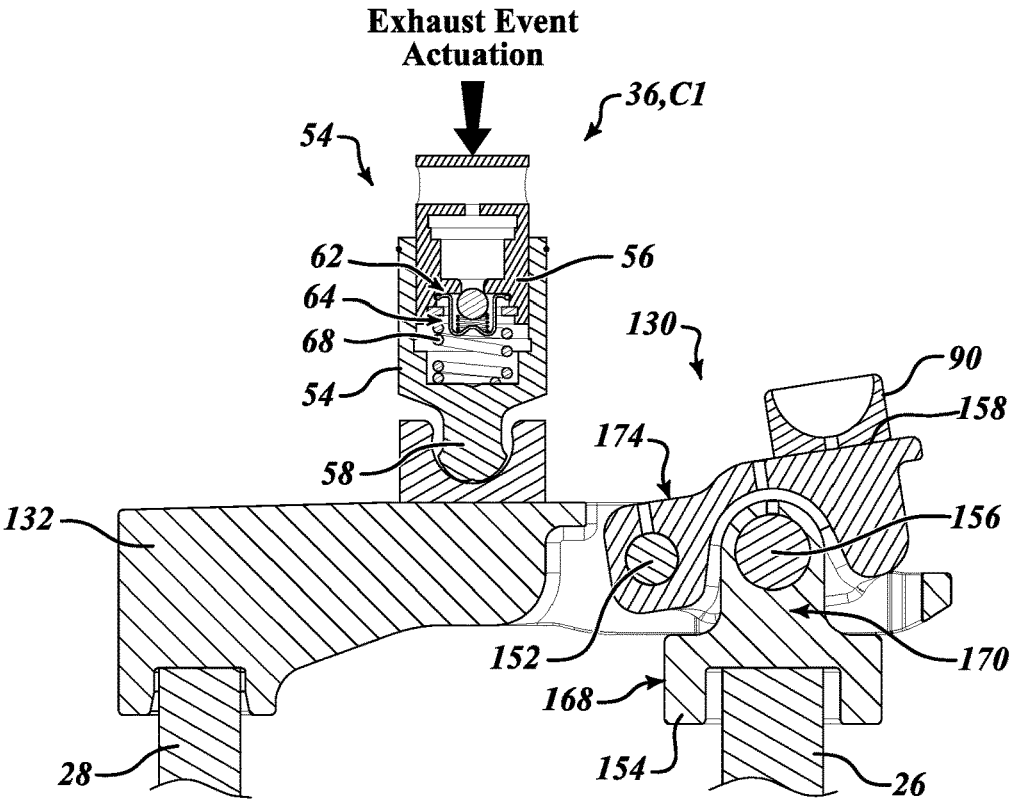
FIG. 8 is a cross-sectional view of the rocker arm assembly shown in FIG. 5 taken along line 8-8 and during a normal exhaust event actuation.
Figure 9:
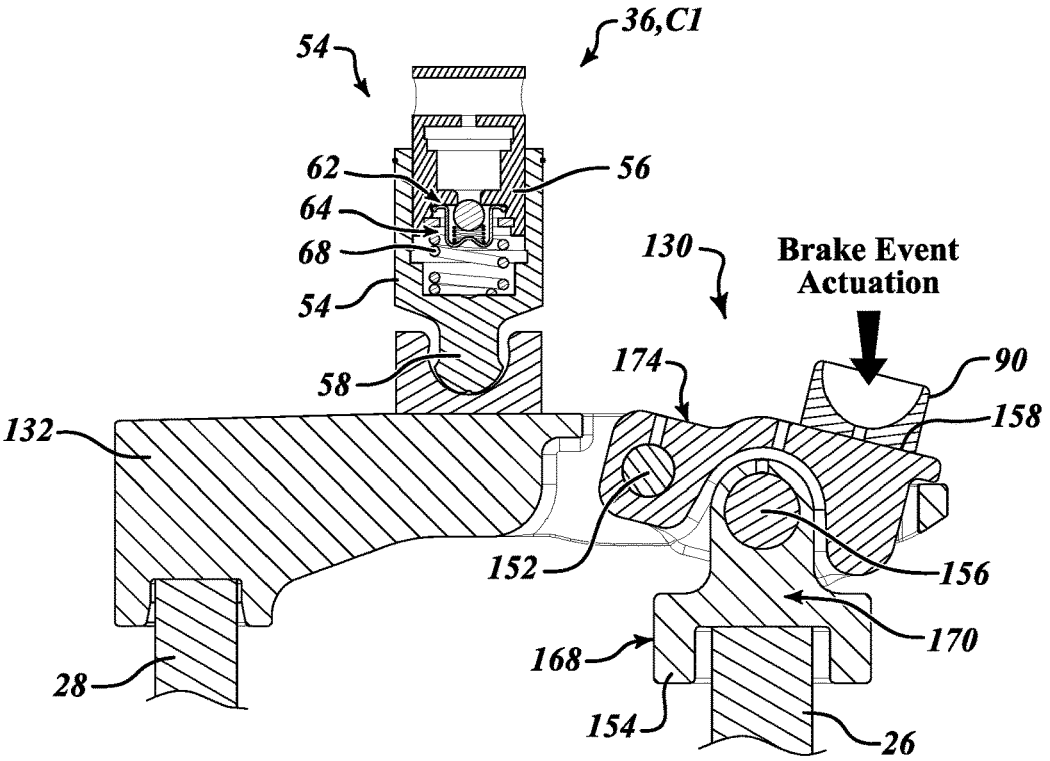
FIG. 9 is a cross-sectional view of the rocker arm assembly shown in FIG. 5 taken along line 8-8 and during a brake event actuation.

The check ball assembly 64 can be configured to hold oil within a chamber 66 between the first and second plunger bodies 54, 56. A biasing mechanism 68 (e.g., a spring) biases second plunger body 56 upward (as shown in FIGS. 8 and 9) to expand the first plunger body 54 to take up any lash. As second plunger body 56 is biased upward, oil is drawn through check ball assembly 64 and into the chamber 66 between plunger bodies 54, 56. Accordingly, oil can be supplied from rocker shaft 22 through a channel (not shown) to the chamber within second plunger 56, and downward pressure can cause downward movement of the first plunger body 54 due to the oil in the chamber 66. However, HLA assembly 36 may have any other suitable configuration that enables assembly 36 to take up lash between the assembly and the valve bridge assembly 32.

With further reference now to FIGS. 2-4, engine brake rocker arm assembly 18 will be further described. The engine brake rocker arm assembly 18 can generally include an engine brake rocker arm 70, an axle 72, a roller 74, an actuator or piston assembly 76, and a check valve assembly 78.

Engine brake rocker arm 70 can receive the rocker shaft 22 and can define a first bore 80 and a second bore 82. The first bore 80 can be configured to at least partially receive the piston assembly 76, and the second bore 82 can be configured to at least partially receive the check valve assembly 78. The axle 72 can be coupled to the rocker arm 70 and can receive the roller 74, which is configured to be engaged by a brake lift profile or cam lobe 84 (FIG. 2) of the cam shaft 24. As such, when the roller 74 is engaged by the cam lobe 84, the brake rocker arm 70 is rotated downward, causing downward movement of the piston assembly 76.

As shown in FIGS. 3 and 4, the actuator or piston assembly 76 can include a first actuator or piston body 86, a second actuator or piston body 88, a socket 90, a biasing mechanism 92, a stopper 94, and a nut 96. The piston assembly 76 can be received by the first bore 80 of the rocker arm 70. The first piston body 86 can include a first closed end that defines a spigot 98, which is received in socket 90 that acts against the valve bridge assembly 32. The second piston body 88 can be secured to rocker arm 70 by nut 96, and stopper 94 can be secured to the second piston body 88. The second piston body 88 and the nut 96 can act as a fine adjustment screw to set the initial position of piston assembly 76.

The biasing mechanism 92 (e.g., a spring) is configured to draw or retract the first piston body 86 upward into the bore 80 to a retracted position. The stopper 94 can be configured to limit upward movement of the first piston body 86. Pressurized oil is selectively supplied through a channel 100 (FIG. 4) to a chamber 102 of the first piston body 86 to move the piston body 86 downward and outward from the bore 80 to an extended position. When the oil supply to channel 100 is suspended, the first piston body 86 returns to the retracted position by the biasing mechanism 92.

The check valve assembly 78 is at least partially disposed in the second bore 82 and can include a spool or check valve 110, a biasing mechanism 112, a cover 114, and a clip 116. The check valve assembly 78 is configured to selectively supply oil from a channel 118 (FIG. 4) in the rocker shaft 22 to the channel 100. The check valve 110 can be biased into a closed position by the biasing mechanism 112 such that oil is not supplied to channel 100. When the oil pressure in channel 118 is sufficient to open the check valve 110, the oil is supplied via the channel 100 to actuate the piston assembly 76 into the extended position. Clip 116 can nest in a radial groove provided in the second bore 82 to retain the check valve assembly 78 therein.

Many known engines with hydraulic valve lash adjustment have a single rocker arm that actuates two valves through a valve bridge across those valves. The engine brake bypasses the bridge and pushes on one of the valves, which cocks or angles the valve bridge, to open a single valve and blow down the cylinder. However, due to the cocked valve bridge, the HLA can react by extending to take up the lash created. This may be undesirable because, after the brake event, the extended HLA assembly can then hold the exhaust valves open with certain loss of compression and possibly piston-to-valve contact.

To overcome this potentially undesirable event, assembly 10 includes valve bridge assembly 32 having a movable lever assembly 130 integrated therein. The lever assembly 130 can pass some of the valve actuation force back to the HLA assembly 36 (via bridge 32), thereby preventing unintended extension of the HLA assembly during the braking event. Thus, lever assembly 130 allows the valve 26 to open during the engine braking operation without allowing downward motion of the valve bridge assembly 32. Moreover, lever assembly 130 significantly reduces the actuation force required for the braking event compared to known systems.

Figure 6:
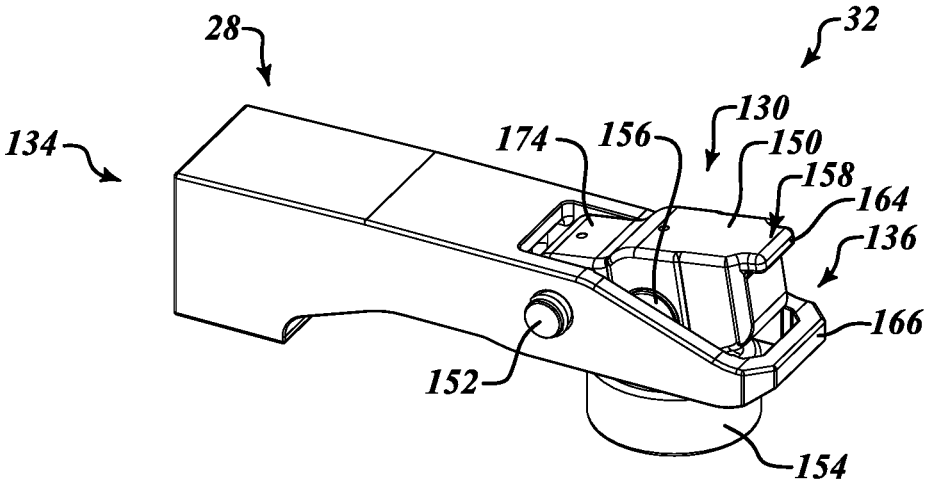
FIG. 6 is a perspective view of a valve bridge assembly of the exhaust valve rocker arm assembly shown in FIG. 1, constructed in accordance to one example of the present disclosure.
Figure 7:
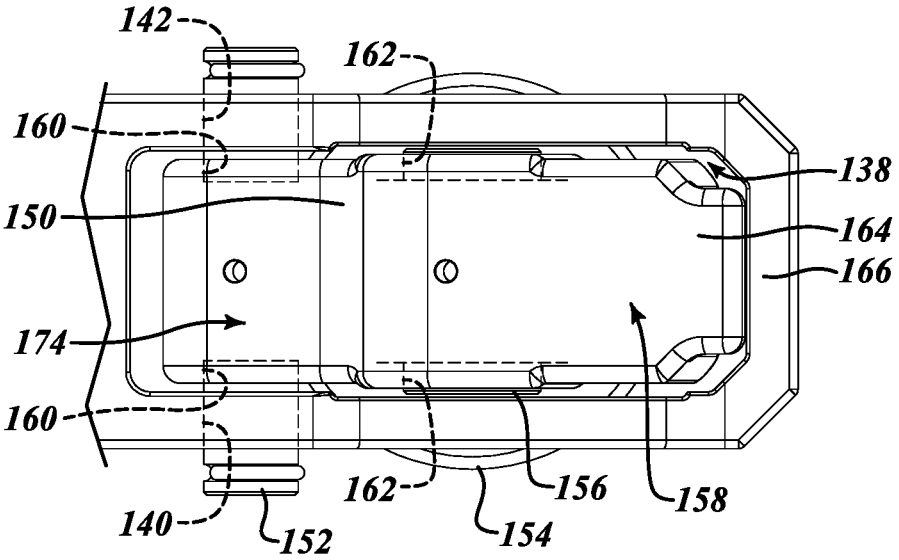
FIG. 7 is a plan view of a portion of the valve bridge assembly shown in FIG. 6.

With additional reference to FIGS. 6 and 7, in one exemplary implementation, the valve bridge assembly 32 comprises the lever assembly 130 disposed within a main bridge main body 132. The bridge main body 132 includes a first end 134 and a second end 136. The first end 134 can be configured to engage valve 28, and the second end 136 can include a first aperture 138, a second aperture 140, and a third aperture 142.

As shown in FIG. 5, the lever assembly 130 can generally include a lever 150, a bridge pin 152, a valve shoe 154, and a valve shoe pin 156. The lever 150 can be disposed within the first aperture 138 and is rotatably coupled to the bridge main body 132 by the bridge pin 152, which extends through the second and third apertures 140, 142 of the bridge main body 132.

The lever 150 includes an engagement surface 158, first opposed openings 160, second opposed openings 162, and a stop flange 164. The engagement surface 158 is configured to be selectively engaged by socket 90 of piston assembly 76. First opposed openings 160 can receive the bridge pin 152, and the second opposed openings 162 can receive the valve shoe pin 156. The stop flange 164 can be configured to engage a bar 166 (FIGS. 6 and 7) of the bridge main 132 to limit downward movement of the lever 150 (as shown in FIG. 6).

The valve shoe 154 includes a main body portion 168 and a connecting portion 170 having an aperture 172 formed therein. The main body portion 168 is configured to receive a portion of the valve 26, and the connecting portion 170 is at least partially disposed within lever 150 such that the connecting portion aperture 172 receives the valve shoe pin 156 to rotatably couple the valve shoe 154 to the lever 150.

Accordingly, lever 150 can be selectively engaged at the engagement surface 158, which can cause rotation about pin 156 and upward movement of an opposed side 174 of the lever that is opposite surface 158 (see FIG. 9). This upward movement of lever end 174 causes upward movement of bridge main body 132 toward HLA assembly 36 to prevent extension thereof.

As such, during operation of rocker arm assembly 20, the exhaust rocker arm assembly 16 can selectively engage the valve bridge main body 132 to actuate valves 26, 28 and perform a normal exhaust event (combustion mode); whereas, the engine brake rocker arm assembly 18 can selectively engage the lever assembly 130 to only actuate valve 26 and perform a brake event actuation (engine braking mode).

The piston assembly 76 is configured to move the first piston body 86 between the retracted position and the extended position. In the retracted position, the first piston body 86 is withdrawn into the bore 80 such that the socket 90 is spaced apart from and does not contact the lever engagement surface 158 even when the cam lobe 84 of camshaft 24 engages the engine brake rocker arm 70.

However, in the extended position, the first piston body 86 extends from the bore 80 such that socket 90 is positioned to engage the lever engagement surface 158. When the cam lobe 84 of camshaft 24 engages the engine brake rocker arm 70, socket 90 rotates the lever about pin 156 to engage the valve 26 and perform the brake event actuation. FIG. 4 shows engine brake rocker arm assembly 18 with piston assembly 76 in the extended position as a result of oil being supplied from rocker shaft 22 through channel 100. In this position, engine brake event actuation is active, and piston assembly 76 is configured to engage the lever assembly 130 of the valve bridge assembly 32 (FIG. 9). The engine brake event actuation capability may be deactivated by ceasing the oil supply through channel 100 and/or 118, thereby causing the piston assembly 76 to move to the retracted position.

With reference now to FIGS. 4, 8 and 9, an exemplary operating sequence of the exhaust valve rocker arm assembly 16 and the engine brake rocker arm assembly 18 will be described.

FIG. 8 shows portions of assemblies 16, 18 during a normal exhaust event actuation where the exhaust rocker arm 30 is engaged by cam lobe 50 of cam shaft 24. In particular, as cam shaft 24 rotates, cam lobe 50 engages roller 44, which causes the exhaust rocker arm 30 to rotate about the rocker shaft 22. In this motion, the exhaust rocker arm 30 pushes through the HLA assembly 36 and moves the valve bridge main body 132 downward to open the first and second exhaust valves 26, 28.

FIG. 9 illustrates portions of assemblies 16, 18 during a brake event actuation where the engine brake rocker arm 70 is engaged by the cam lobe 84 of cam shaft 24. In particular, as cam shaft 24 rotates, cam lobe 84 engages roller 74, which causes the brake rocker arm 70 to rotate about the rocker shaft 22. When the first piston body 86 is in the extended position, the brake rocker arm 70 pushes socket 90 downward to engage and cause downward movement of lever engagement surface 158. This in turn can cause downward movement of the valve shoe 154, which opens valve 26 to brake the engine. Further, as lever 150 pivots about pin 156, lever end 174 moves upward against bridge main body 132, which pushes against the HLA assembly 36 to prevent extension thereof during the brake event.

FIG. 10 illustrates a valve train assembly 200 constructed in accordance to one example of the present disclosure. The valve train assembly 200 may be similar to valve train assembly 10 as shown in FIG. 2 except that component C1 is an HLA assembly 208 and component C2 is a combined HLA and added motion capsule 210. HLA assembly 208 can be similar to the above described HLA assembly 36 in that it includes hydraulic fluid to adjust the lash height and is configured to automatically take up any lash between the HLA assembly 208 and the valve bridge assembly 32. Moreover, although not shown, HLA assembly 208 may include components similar to HLA assembly 36. However, HLA assembly 208 is not limited thereto and may include any suitable structure that enables assembly 208 to function as described herein The combined capsule 210 can include an HLA assembly 212 and an added motion assembly 214. HLA assembly 212 can be similar to the above described HLA assembly 36 in that it includes hydraulic fluid to adjust the lash height and is configured to automatically take up any lash between the capsule 210 and the valve bridge assembly 32. Moreover, although not shown, HLA assembly 212 may include components similar to HLA assembly 36. However, HLA assembly 212 is not limited thereto and may include any suitable structure that enables assembly 212 to function as described herein.

In the example embodiment, the added motion assembly 214 is similar to the above described piston assembly 76 in that added motion assembly 214 is configured to move between a retracted position and the extended position. In this way, added motion assembly 214 is by default in the retracted position where it can be withdrawn such that a socket 290 is spaced apart from and does not contact the lever engagement surface 158 even when the cam lobe 84 of camshaft 24 engages the engine brake rocker arm 70. However, when selectively activated into the extended position, socket 290 is positioned to engage the lever engagement surface 158. When the cam lobe 84 of camshaft 24 engages the engine brake rocker arm 70, socket 290 rotates the lever 150 about pin 156 to engage the valve 26 and perform the brake event actuation. As such, this configuration of valve train assembly 200 provides HLA control on bridge main body 132 via the HLA assembly 208 of exhaust valve rocker arm assembly 16, and combined HLA and added motion control on lever 150 via the combined HLA and added motion capsule 210. In other configurations, socket 290 or other portion of added motion assembly 214 can be coupled to lever 150 to prevent relative motion therebetween, for example via a clip, a press fit into lever 150, or other suitable means to maintain contact between added motion assembly 214 and lever 150. As such, retraction of assembly 214 can lift lever 150 away from valve 26 to prevent contact therebetween.

FIG. 11 illustrates a valve train assembly 300 constructed in accordance to one example of the present disclosure. The valve train assembly 300 may be similar to valve train assembly 10 as shown in FIG. 2 except that component C1 is a rigid motion transfer capsule or assembly 310 and component C2 is a combined HLA and added motion capsule 312.

Rigid motion transfer assembly 310 is disposed at least partially within exhaust rocker arm 30 and includes a body 314 connected to a spigot 316 disposed within a socket 318. In the example embodiment, the rigid motion transfer assembly 310 does not include a hydraulic lash adjustment feature and transfers motion from the exhaust rocker arm to the bridge main body 132 to actuate valves 26, 28.

In the example embodiment, the combined HLA and added motion capsule 312 can include an HLA assembly 318 and an added motion assembly 320. HLA assembly 318 can be similar to the above described HLA assembly 36 in that it includes hydraulic fluid to adjust the lash height and is configured to automatically take up any lash between the capsule 312 and the valve bridge assembly 32. Moreover, although not shown, HLA assembly 318 may include components similar to HLA assembly 36. However, HLA assembly 318 is not limited thereto and may include any suitable structure that enables assembly 318 to function as described herein.

In the example embodiment, the added motion assembly 320 is similar to the above described piston assembly 76 in that added motion assembly 320 is configured to move between a retracted position and the extended position. In this way, added motion assembly 320 is by default in the retracted position where it can be withdrawn such that a socket 390 is spaced apart from and does not contact the lever engagement surface 158 even when the cam lobe 84 of camshaft 24 engages the engine brake rocker arm 70. However, when selectively activated into the extended position, socket 390 is positioned to engage the lever engagement surface 158. When the cam lobe 84 of camshaft 24 engages the engine brake rocker arm 70, socket 390 rotates the lever 150 about pin 156 to engage the valve 26 and perform the brake event actuation. As such, this configuration of valve train assembly 300 provides non-HLA control on bridge main body 132 via the motion transfer assembly 310 of exhaust valve rocker arm assembly 16, and combined HLA and added motion control on lever 150 via the combined HLA and added motion capsule 312. In other configurations, socket 390 or other portion of capsule 312 can be coupled to lever 150 to prevent relative motion therebetween, for example via a clip, a press fit into lever 150, or other suitable means to maintain contact between capsule 312 and lever 150. As such, retraction of combined capsule 312 can lift lever 150 away from valve 26 to prevent contact therebetween.

FIG. 12 illustrates a valve train assembly 400 constructed in accordance to one example of the present disclosure. The valve train assembly 400 may be similar to valve train assembly 10 as shown in FIG. 2 except that component C1 is an HLA assembly 410 and component C2 is a lost motion capsule 412. HLA assembly 410 can be similar to the above described HLA assembly 36 in that it includes hydraulic fluid to adjust the lash height and is configured to automatically take up any lash between the HLA assembly 410 and the valve bridge assembly 32. Moreover, although not shown, HLA assembly 410 may include components similar to HLA assembly 36. However, HLA assembly 410 is not limited thereto and may include any suitable structure that enables assembly 410 to function as described herein.

In one example implementation, lost motion capsule 412 can generally include an outer body 420, a plunger 422, a latching mechanism 424, and a ball pivot 426. Outer body 420 includes an oil communication groove 428 in fluid communication with a plurality of oil ports 430 via a plurality of oil channels 432. Plunger 422 is disposed at least partially within outer body 420 and is configured to selectively slide within the outer body 420 when lost motion capsule 412 is in an unlatched position (not shown). Ball pivot 426 is received within the plunger 422, and the ball pivot 426 is configured to interface with the lever 150. One or more biasing mechanisms 434 (e.g., a spring) can be disposed between the plunger 422 and a cap 436 to absorb motion of rocker arm engine brake rocker arm 70 when lost motion capsule 412 is in the unlatched position, and the cap 436 can provide a sliding interface with the rocker arm 70. The biasing mechanism 434 can be configured to bias the plunger 422 outward from outer body 420 and absorb motion of the rocker arm 70 when the lost motion capsule 412 is in the deactivation mode, thereby providing a lost motion feature. However, it will be appreciated that lost motion 412 is not limited to the described structure and may include any suitable structure that enables lost motion capsule 412 to function as described herein.

Thus, when in an activated or latched position (shown), the lost motion capsule 412 acts as a rigid or unitary body and transfers motion from the rocker arm 70 to the valve 26 via lever 150. In contrast, when the lost motion capsule 412 is in the deactivated or unlatched position, downward movement of rocker arm 70 and upward resistance of lever 150 causes the plunger 422 to slide upward within outer body 420. The biasing mechanism 434 subsequently absorbs the downward motion of rocker arm 70 without transferring said motion to the lever 150 or valve 26. As such, this configuration of valve train assembly 400 provides HLA control on bridge main body 132 via HLA assembly 410, and selective lost motion control on lever 150 via the lost motion capsule 412. In other configurations, capsule 412 can be coupled to lever 150 to prevent relative motion therebetween, for example via a clip, a press fit into lever 150, or other suitable means to maintain contact between capsule 412 and lever 150.

Described herein are systems and methods for braking an engine. The system includes an exhaust valve rocker arm that engages a valve bridge to actuate two valves to perform an exhaust event. In one aspect, the valve bridge includes a main body and a lever integrated therein, the lever being rotatable relative to a valve bridge main. The rotatable lever can be selectively engaged and rotated by an engine brake rocker arm to actuate one of the two valves to perform an engine brake event. The exhaust valve rocker arm and the engine brake rocker arm include various combinations of components to provide hydraulic lash adjustment, added motion to actuate the brake event, and/or lost motion to actuate the brake event.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. A valve train assembly comprising:

a first exhaust valve;

a second exhaust valve;

a valve bridge including a main body and a lever rotatably coupled to the main body, the main body configured to engage the first exhaust valve, and the lever configured to engage the second exhaust valve;

an exhaust valve rocker arm assembly configured to selectively open the first and second exhaust valves, the exhaust valve rocker arm assembly including an exhaust valve rocker arm with a hydraulic lash adjuster (HLA) assembly coupled thereto, the HLA assembly in contact with the valve bridge main body; and an engine brake rocker arm assembly configured to selectively open the second exhaust valve and including an engine brake rocker arm with a lost motion capsule coupled thereto, the lost motion capsule configured to selectively engage and rotate the lever to open the second exhaust valve;

wherein the lost motion capsule is configured to move between an activated position and a deactivated position;

wherein in the activated position, the lost motion capsule acts as a rigid body configured to transfer motion from the engine brake rocker arm to the lever to thereby rotate the lever and open the second exhaust valve;

wherein in the deactivated position, the lost motion capsule is configured to collapse when the lost motion capsule contacts the lever so as to absorb the motion of the engine brake rocker arm; and wherein the lost motion capsule comprises an outer body, a plunger, a latching mechanism, and a ball pivot.

2. The valve train assembly of claim 1, wherein the HLA assembly is in continuous contact with the valve bridge main body.

3. The valve train assembly of claim 1, wherein the lost motion capsule does not include a hydraulic lash adjustment feature.

4. The valve train assembly of claim 1, wherein the lost motion capsule is directly coupled to the lever.

5. The valve train assembly of claim 1, wherein the HLA assembly comprises an outer housing, a first piston body, and a second piston body, the first piston body and the second piston body at least partially disposed within the outer housing and defining a central chamber therebetween configured to receive a fluid, and wherein the hydraulic actuator assembly further comprises a biasing mechanism disposed between the first piston body and the second piston body.

6. The valve train assembly of claim 1, wherein the lever includes an engagement surface, an opposed side opposite the engagement surface, and a stop flange extending therefrom, wherein the engagement surface is configured to be selectively engaged by the lost motion capsule, the opposed side is configured to move upwardly when the engagement surface is moved downward, and wherein the stop flange is configured to selectively engage an edge of the main body to limit downward movement of the lever.

7. The valve train assembly of claim 1, wherein the outer body includes an oil communication groove in fluid communication with one or more oil ports extending through the outer body.

8. The valve train assembly of claim 1, wherein the plunger is disposed at least partially within the outer body and is configured to selectively slide within the outer body when the lost motion capsule is in the deactivated position.

9. The valve train assembly of claim 1, wherein the ball pivot is received within the plunger and configured to interface with the lever.

10. The valve train assembly of claim 1, further comprising a biasing mechanism disposed between the plunger and a cap, the biasing mechanism configured to bias the plunger outward from the outer body to absorb motion of the engine brake rocker arm when the lost motion capsule is in the deactivated position.

11. A valve train assembly comprising:

a first exhaust valve;

a second exhaust valve;

a valve bridge including a main body and a lever rotatably coupled to the main body, the main body configured to engage the first exhaust valve, and the lever configured to engage the second exhaust valve;

an exhaust valve rocker arm assembly configured to selectively open the first and second exhaust valves, the exhaust valve rocker arm assembly including an exhaust valve rocker arm with a hydraulic lash adjuster (HLA) assembly coupled thereto, the HLA assembly in contact with the valve bridge main body; and an engine brake rocker arm assembly configured to selectively open the second exhaust valve and including an engine brake rocker arm with a lost motion capsule coupled thereto, the lost motion capsule configured to selectively engage and rotate the lever to open the second exhaust valve, wherein opening the second exhaust valve performs a brake event actuation, wherein the lever is coupled to the main body such that rotation of the lever and engagement of the second exhaust valve occurs without rotation of the main body, and wherein the main body includes an aperture, the lever at least partially disposed within the aperture.

12. The valve train assembly of claim 11, wherein the HLA assembly is in continuous contact with the valve bridge main body.

13. The valve train assembly of claim 11, wherein the lever is rotatably coupled to the main body by a bridge pin extending through the main body.

14. A valve train assembly comprising:

a first exhaust valve;

a second exhaust valve;

a valve bridge including a main body and a lever rotatably coupled to the main body, the main body configured to engage the first exhaust valve, and the lever configured to engage the second exhaust valve;

an exhaust valve rocker arm assembly configured to selectively open the first and second exhaust valves, the exhaust valve rocker arm assembly including an exhaust valve rocker arm with a hydraulic lash adjuster (HLA) assembly coupled thereto, the HLA assembly in contact with the valve bridge main body; and an engine brake rocker arm assembly configured to selectively open the second exhaust valve and including an engine brake rocker arm with a lost motion capsule coupled thereto, the lost motion capsule configured to selectively engage and rotate the lever to open the second exhaust valve, wherein no part of the lever overlaps the HLA assembly when viewed in an actuation direction of the first and second exhaust valves.

* * * * *